United States Patent [19]

Nagai et al.

[11] 3,943,812

[45] Mar. 16, 1976

[54] TOUCH RESPONSIVE SENSOR IN ELECTRONIC KEYBOARD MUSICAL INSTRUMENT

[75] Inventors: Yohei Nagai; Masatada Wachi, both of Hamamatsu, Japan

[73] Assignee: Nippon Gakki Seizo Kabushiki Kaisha, Hamamatsu, Japan

[22] Filed: Nov. 1, 1974

[21] Appl. No.: 520,225

[30] Foreign Application Priority Data

Nov. 2, 1973 Japan ..... 48-123760

[52] U.S. Cl. ..... 84/1.1; 84/1.27; 84/DIG. 7; 317/249 R; 340/365 C

[51] Int. Cl.[2] ..... G10H 1/02; G10H 5/02

[58] Field of Search ..... 84/1.01, 1.04, 1.13–1.15, 84/1.24, 1.26, DIG. 7, 1.09, 1.1, 1.27; 317/249 R, 250; 340/365 C

[56] References Cited

UNITED STATES PATENTS

| | | | |
|---|---|---|---|
| 2,270,789 | 1/1942 | Smith | 84/DIG. 7 |
| 2,542,611 | 2/1951 | Zuck | 84/1.14 |
| 2,656,755 | 10/1953 | Miessner | 84/1.14 |
| 2,732,625 | 1/1956 | Buisson | 317/250 UX |
| 2,756,286 | 7/1956 | Johnson et al. | 317/250 X |
| 2,873,637 | 2/1959 | Herold | 84/1.04 |
| 3,293,640 | 12/1966 | Chalfin et al. | 340/365 C |
| 3,659,163 | 4/1972 | Borisov et al. | 317/249 R |
| 3,671,822 | 6/1972 | Leno | 317/249 R |
| 3,754,495 | 8/1973 | Honegger | 84/1.01 X |
| 3,836,909 | 9/1974 | Cockerell | 340/365 C |

*Primary Examiner*—L. T. Hix
*Assistant Examiner*—Stanley J. Witkowski
*Attorney, Agent, or Firm*—Cushman, Darby & Cushman

[57] ABSTRACT

A touch responsive sensor for an electronic keyboard musical instrument of a variable capacitor type, which comprises a pair of electrodes spaced apart from each other, and an intermediate electrode interposed between the pair of electrodes and separated from each of the pair of electrodes by a dielectric. The intermediate electrode is movable from near one of the pair of electrodes toward the other of the pair of electrodes in accordance with the movement of each playing key of the electronic musical instrument. Thus, in the course of a key depressing movement, first and second touch responsive controlling signals are derived from, respectively, between the one of the pair of electrodes and the intermediate electrode and between the other of the pair of electrodes and the intermediate electrode in accordance with the variation of capacitance produced therebetween.

11 Claims, 10 Drawing Figures

TOUCH RESPONSIVE SENSOR IN ELECTRONIC KEYBOARD MUSICAL INSTRUMENT

BACKGROUND OF THE INVENTION

1. Field of the invention

This invention relates to a key-operated touch responsive sensor to be used in an electronic keyboard musical instrument and more particularly to a sensor device for deriving controlling signals in accordance with the displacement of a key depressed in an electronic musical instrument.

2. Description of the prior art

In electronic musical instruments, a technique is utilized for minutely controlling a musical sound in accordance with the movement of a key depressed, which is called "touch control" or "touch responsive control." Such touch responsive control has so far been effected by the detection of the depression speed of a key or minute displacements thereof at key-depressed positions with the use of photoelectric elements or semiconductor pressure sensitive elements, thereby controlling the tone volume or the tone color therewith. According to such conventional techniques, however, the semiconductor elements have the defect of showing large temperature dependence characteristics, while the photoelectric elements have the shortcoming of being slow in response. Thus, additional circuits are necessary for removing such drawbacks, resulting in a complicated and expensive structure. Further, there has been proposed no touch responsive control means which detects and utilizes both the depression speed of a key and the minute displacement of the key at key-depressed positions.

SUMMARY OF THE INVENTION

An object of this invention, therefore, is to provide a touch responsive sensor means having a simple and economical structure and rapidly responding to the depression speed of a key and to the minute displacement of the key in the depressed state.

According to an embodiment of this invention, there is provided a touch responsive sensor comprising a pair of fixed electrodes and a movable intermediate electrode mechanically coupled with a key, thereby forming variable capacitors with fixed electrodes, the capacitances of the variable capacitors well representing the movement of the key. The touch responsive sensor according to this invention is rapid in its response, has no drawback of temperature dependence characteristic, and is simple and economical. The touch responsive sensor according to this invention provides different kinds of controlling signals for the depression speed of a key and for the minute displacement of the key in depressed state, enabling sophisticated expression in musical performance.

Other objects, features and advantages of this invention will become apparent in the following detailed description made in conjunction with the accompanying drawings.

DESCRIPTION OF THE PREFERRED EMBODIMENTS

Figure 1:
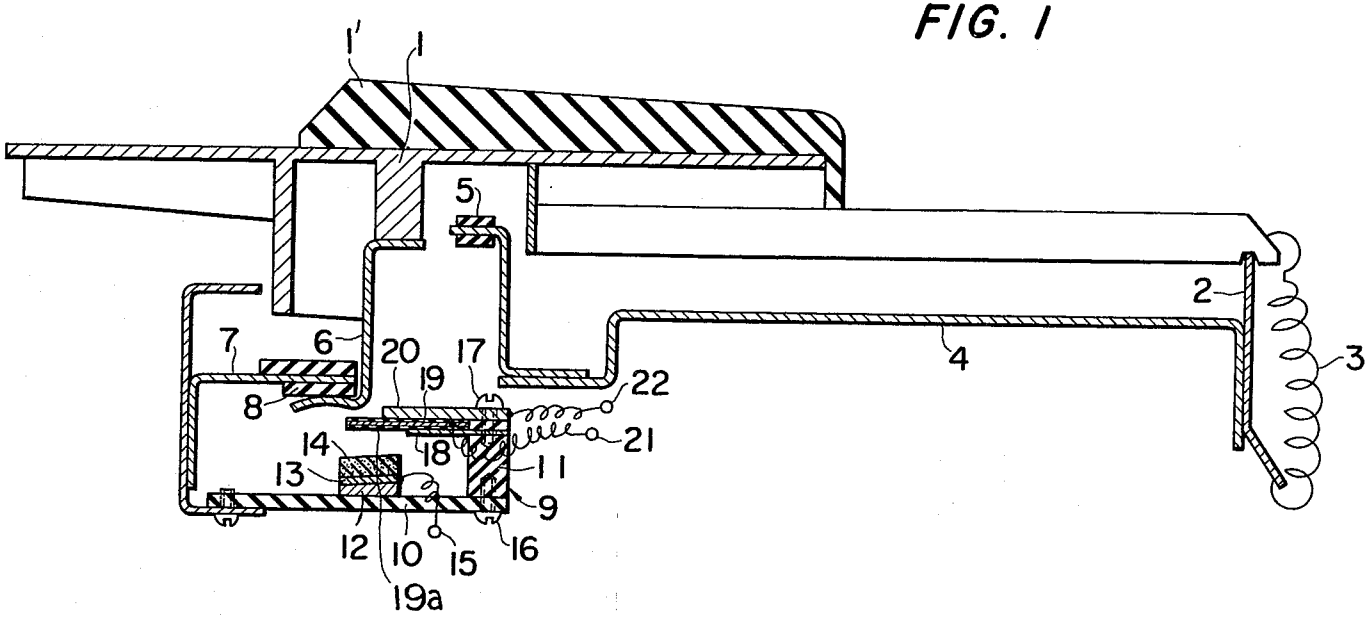
FIG. 1 is a side view of a touch responsive sensor for use in an electronic keyboard musical instrument according to an embodiment of this invention, shown with a corresponding key.

In an electronic keyboard musical instrument, a plurality of playing keys are arranged side by side with key 1 and 1' shown in FIG. 1. Each key 1 is pivotally supported with a member 2 at its rear end and is held in a non-depressed state by a coiled spring 3 so that the key is movable in a vertical direction with the support member 2 as a fulcrum. The downward movement of the key 1 is limited by a felt-wearing member 5 extending from a frame 4. An actuator 6 is provided on the under-side of the key 1. The actuator 6 is engaged with a stopper 7 which is mounted on the frame 4 and is provided with a buffer member 8 formed of felt to limit the upward movement of the key 1. Below the actuator 6 is provided a sensor mount 9 mentioned in detail hereinafter. The sensor mount 9 comprises a substrate 10 fixed to the frame 4 and an up-standing member 11 fixed to the substrate 10 with nylon screws 16. The substrate 10 and upstanding member 11 are made of an electrically insulating material, such as a bakelite. On the upper end of the upstanding member 11, a plate spring 18 and an upper electrode plate 20 of electrically conducting material are fixed in face-to-face and spaced-apart relation by a nylon screw 17. An intermediate electrode plate 19 of electrically conducting material is fixed on a free end portion of the plate spring 18 so as to be in close proximity of the upper electrode plate 20. The intermediate electrode plate 19, made, for example, is clad with a thin layer of a dielectric material **19*a*, such as alumite (corrosion resistant oxide film), so that the upper electrode plate 20 is separated from the intermediate electrode plate 19 by a dielectric to produce a capacitance therebetween. The intermediate electrode plate 19 is extended further at the free end thereof than the upper electrode plate 20, and the exposed upper surface of the intermediate electrode plate 19 is capable of being depressed by the actuator 6. A projection 12 is provided on the substrate 10 under the intermediate electrode 19. A lower electrode plate 14 made of an elastic and electrically conductive material such as a conductive rubber is fixed on the projection 12 through an electrically conductive plate 13. A sufficient space is formed between the intermediate electrode plate 19 and the lower electrode plate 14, so that the latter plate 14 can travel, in accordance with the movement of the key 1, from a position wherein the electrode plate 19 is in contact with the upper electrode plate 20 through the dielectric 19*a* to a position wherein the electrode plate 19 comes in contact with the lower electrode plate 14. An electric terminal 15 is connected to the lower electrode 14 through the conductive plate 13. Other electric terminals 21 and 22 are connected to the intermediate and upper electrodes 19 and 20, respectively. The upper electrode 20 may be formed of a single metal plate or an insulator plate having a metallic layer on the side facing the intermediate electrode plate 19. The dielectric separating the intermediate electrode plate 19 from each of the upper and lower electrode plates 20 and 14** may be made of such material as ceramics, glass, mica, polystyrene, and air.

Instead of the above-mentioned example, dielectric or insulating layers may be provided on the upper and lower electrodes 20 and 14 and the intermediate electrode 19 may be formed of an elastic conductor such as a conducting rubber. The use of the elastic conductor as the intermediate electrode is effective not only for absorbing shocks caused by the actuator 7, but also for producing a uniform contact between the electrode plates 19 and 20 all over the contacting surfaces thereof. Further, the intermediate electrode 19 may be magnetized by loading a magnet, utilizing a magnetized conductive rubber, etc. and magnetic material such as iron may be disposed at the upper and lower electrodes so that the discontact and the contact of the intermediate electrode from the upper electrode and to the lower electrode become clear and sharp.

In the state shown in FIG. 1, the key 1 is not depressed and is held horizontal with the actuator 6 engaged with the stopper 7. Once, however, the key 1 is depressed, the actuator 6 depresses down the intermediate electrode 19 against the resiliency of the spring plate 18 toward the lower electrode 14.

Figure 2A:
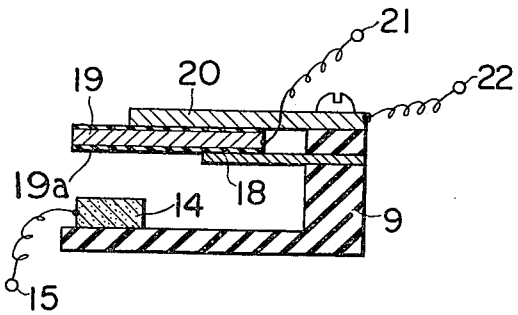
FIGS. 2A to 2C are schematic side views of the touch responsive sensor of FIG. 1 in various operational states for illustrating the operation of the sensor.
Figure 2B:
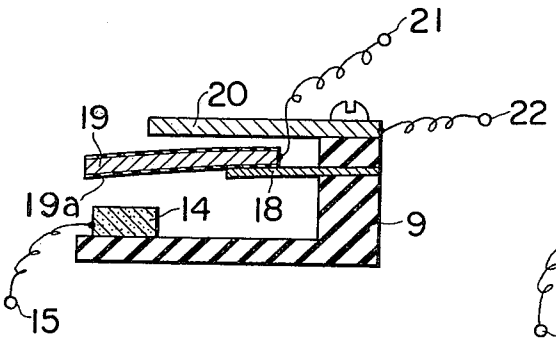
Figure 2C:
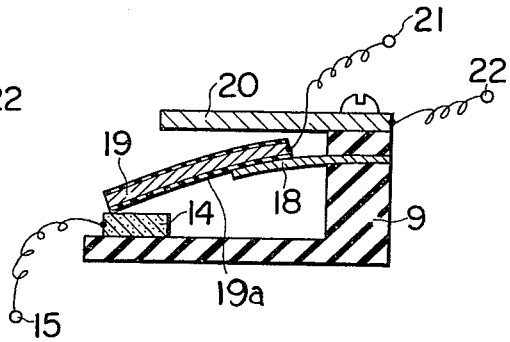

The operation of the key structure of FIG. 1 will be described in detail hereinbelow, referring to FIGS. 2A to 2C. In FIG. 2A, the intermediate electrode 19 is not depressed by the actuator and a relatively large electrostatic capacitance is formed between the electrode 19 and the upper electrode 20 through a very short separation (equal to the thickness of the thin dielectric layer formed on the electrode 19 or 20). In this instance, the intermediate and the lower electrodes 19 and 14 are separated from each other by a larger distance than between the electrodes 19 and 20, and accordingly the electrostatic capacitance therebetween is not so large. As the key is being depressed, the actuator begins to make contact with and depresses the intermediate electrode 19. FIG. 2B shows such an intermediate state. In this state, the electro-static capacitance between the upper and intermediate electrodes 20 and 19 is decreased due to the increase in the separation therebetween, while the electro-static capacitance between the intermediate and lower electrodes 19 and 14 is increased a little due to the decrease in the separation between these electrodes 19 and 14, when compared with the state shown in FIG. 2A. FIG. 2C shows a state where the intermediate electrode 19 is depressed further downward so that it makes contact with the lower electrode 14. In such a state, the capacitance between the electrodes 19 and 20 is further decreased, while that between the electrodes 19 and 14 is further increased. In such a case, the use of an elastic material such as a conductive rubber for the lower electrode 14 as is described above is very effective for removing shocks. Further, in this state, if the intermediate electrode 19 is made of an elastic material, varying of the contact area between the electrodes 19 and 14 is facilitated.

As is apparent from the above description, capacitance variation of two variable capacitances included in a face-to-face electrode type capacitor having a movable intermediate electrode coupled with the movement of a key is derived through terminals 15, 21 and 22 color. In utilized to control the tone volume and/or the tone color.In the touch responsive sensor of the structure as described above, at the beginning of a key depression the capacitance variation between the electrodes 19 and 20 is attained in accordance with the depression speed (or more precisely the variation of positions) of the key and, at depressed positions if the key is minutely moved up and down, another capacitance variation between the electrodes 19 and 14 is attained in accordance with that minute displacements of the key. Thus, according to the touch responsive sensor of this invention, a controlling signal corresponding to the depression speed of a key can be derived through the terminals 21 and 22 and may be utilized, for example, to control the rising characteristic of a musical tone, and another controlling signal corresponding to the minute displacements of the key in depressed states can be derived through the terminals 21 and 15 and may be utilized, for example, for controlling the sustaining state of a musical tone. Thus, this invention provides variations in the musical performance and enhances the expression of an electronic musical instrument. Further, the touch responsive sensor according to this invention is simply formed of an opposed electrode type capacitor which is of low cost and has basically lower temperature dependence characteristics than a semiconductor element and faster response speed than a photoelectric element.

Figure 3:
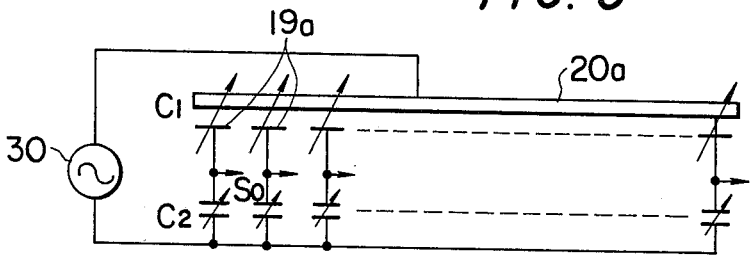
FIG. 3 is a schematic electrical representation of a touch responsive sensor according to another embodiment of this invention.

FIG. 3 shows another embodiment of the touch responsive sensor according to this invention, in which a common upper electrode **20*a* is provided for all the intermediate electrodes 19*a*. Usually, the respective intermediate electrodes 19*a* are driven by the respective keys and thus cannot be formed into a common electrode. But the upper and/or lower electrodes may be formed into a common electrode. The use of a common electrode can simplify the structure. In the embodiment of FIG. 3, an alternating voltage source 30 is connected between the upper electrode 20*a* and the lower electrodes and output signals $S_o$ are derived out from equivalent interconnections of the variable capacitor C1 and C2 formed between the upper electrode 20*a* and the intermediate electrodes 19a and between the intermediate electrodes 19*a*** and the lower electrodes.

Figure 4:
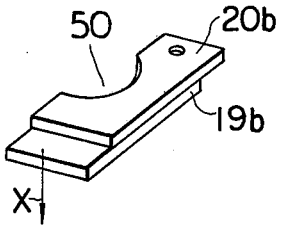
FIGS. 4 and 5 show the essential parts of touch responsive sensors according to further embodiments of the present invention.
Figure 6A:
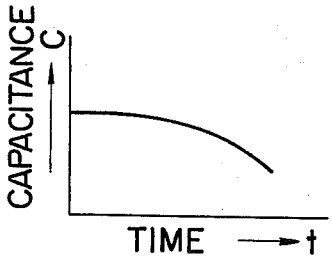
FIGS. 6A and 6B are typical characteristics of the capacitance variation and the tone controlled volume variation obtained through the sensor of this invention.
Figure 5:
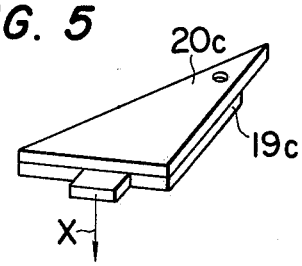
Figure 6B:
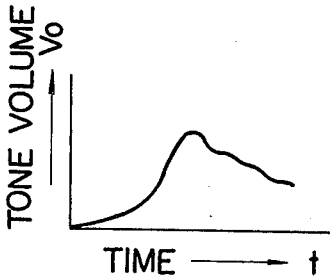

FIGS. 4 and 5 show alternations of the electrode shape for the capacitor formed of an upper electrode and an intermediate electrode. In the example of FIG. 4, semi-circular cut-aways 50 are provided in the upper and the intermediate electrodes **20*b* and 19*b* near the contacting portion thereof. In FIG. 5, an upper electrode 20*c* and an intermediate electrode 19*c* are both formed triangular. Of course, these irregular outer shapes may be formed only in either of the upper and intermediate electrodes. In these examples, when the intermediate electrode 19*b* or 19*c* is depressed in the direction indicated by an arrow X to increase the separation from the upper electrode 20*b* or 20*c*, the capacitance shows less variation at the beginning of the depression but steep variation appears at the intermediate as is shown in FIG. 6A. Using the capacitance variation characteristics as shown in FIG. 6A,** mild attack control of the tone volume as shown in FIG. 6B can be achieved.

Figure 7:
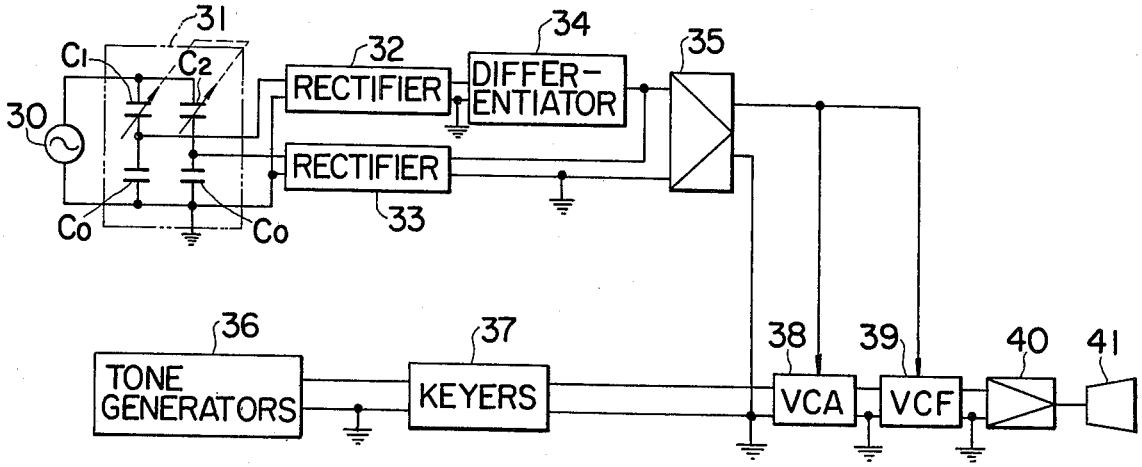
FIGS. 7 is a schematic electrical block diagram of an electronic musical instrument embodying the touch responsive sensor according to this invention.

FIG. 7 shows the system of an electronic musical instrument embodying the present touch responsive sensors. A touch responsive sensor 31 is equivalently shown by a parallel connection of a series circuit of a variable capacitor C1 and a fixed capacitor Co and another series circuit of a variable capacitor C2 and a fixed capacitor Co, and an alternating voltage from an alternating voltage source 30 is applied to the sensor 31. The terminal voltage of the variable capacitor C1 is rectified by a rectifier 32 and supplied to an amplifier 35 through a differentiator 34. The terminal voltage of the other variable capacitance C2 is rectified by a rectifier 33 and supplied to the amplifier 35. The output signal of this amplifier 35 is applied to the respective input terminals of a voltage controlled amplifier 38 for controlling the tone volume and a voltage controlled filter 39 for controlling the tone color. The tone signals generated from tone signal generators 36 are selected through keying circuits 37 interlocked with the keys in the keyboard, and are subjected to amplitude control in the voltage controlled amplifier 38. The output signal of this voltage controlled amplifier 38 is given a predetermined musical tone spectrum in the voltage controlled filter 39 and is derived from a loud speaker system 41 through an amplifier 40.

When a key is depressed, the variable capacitance C1 decreases in accordance with the depression speed and the terminal voltage increases. The terminal voltage of the capacitor C1 is rectified by the rectifier 32 and differentiated by the differentiator 34 to form a signal representing the depression speed of the key. This depression speed signal is applied to the voltage controlled amplifier 38 and the voltage controlled filter 39 through the amplifier 35 so as to control the tone volume and the tone in attacking state. Next, when the key approaches the maximum depressed position, the other variable capacitance C2 increases. At such depressed position, the capacitance C2 varies remarkably in accordance with the minute displacement of the key and the terminal voltage of the capacitance C2 varies accordingly and hence varies the terminal voltage of the capacitance C1. The signal corresponding to the terminal voltage variation of the capacitance C2 is rectified and amplified through the rectifier 33 and the amplifier 35, and when used for controlling the tone volume and the tone color in the sustaining state. For example, when an operator finely vibrates a key near the maximum depressed position, the tone volume and the tone color are also given a vibrational characteristic.

We claim:

1. A touch responsive sensor for obtaining electric signals in accordance with the movement of each key in an electronic musical instrument, comprising first and second electrodes of electrically conductive material spaced apart from each other, an intermediate electrode of electrically conductive material interposed between said first and second electrodes and electrically insulated from each of said first and second electrodes by a dielectric, means for maintaining said intermediate electrode adjacent said first electrode, said intermediate electrode being reciprocatively operable by the key and movable from near said first electrode toward said second electrode, producing variations of capacitance therebetween, the movement of said intermediate electrode generating a first touch responsive controlling signal in accordance with the variation of capacitance produced between said first and intermediate electrodes and a second touch responsive controlling signal in accordance with the variation of capacitance produced between said second and intermediate electrodes.

2. A touch responsive sensor according to claim 1, wherein said dielectric is a layer formed on the outer surface of said intermediate electrode.

3. A touch responsive sensor according to claim 1, wherein at least one of said first and second electrodes includes a magnetic material member and said intermediate electrode includes a magnetized member.

4. A touch responsive sensor according to claim 1, wherein at least one of said intermediate and second electrodes is made of an elastic and electrically conductive material.

5. A touch responsive sensor according to claim 1, further comprising actuator means fixed to the key for moving said intermediate electrode.

6. A touch responsive sensor according to claim 2, wherein said intermediate electrode is formed of an aluminum plate clad with an electrically insulating oxide film.

7. A touch responsive sensor according to claim 1, wherein at least one of said first and intermediate electrodes has an irregular outer shape.

8. A touch responsive sensor according to claim 2, wherein said intermediate electrode is in contact with said first electrode through said dielectric formed on the intermediate electrode.

9. A keyboard structure for an electronic musical instrument comprising a plurality of keys arranged side by side, a first single electrode of electrically conductive material, a plurality of intermediate electrodes of electrically conductive material each disposed corresponding to one of said plurality of keys, a second electrode of electrically conductive material disposed below each of said intermediate electrodes said first single electrode being common to all of said intermediate electrodes, each of said intermediate electrodes being electrically insulated from each of said first and second electrodes by a dielectric and being mechanically coupled with each of said keys and movable from near said first electrode toward said second electrode, producing variations of capacitance between said first and each of said intermediate electrodes, the movement of said intermediate electrode generating a first touch responsive controlling signal in accordance with the variation of capacitance produced between said first electrode and each of said intermediate electrodes and a second touch responsive controlling signal in accordance with the variation of capacitance produced between said second electrode and each of said intermediate electrodes.

10. In an electronic musical instrument of type having a plurality of tone generator circuits for producing tone signals, a plurality of manually operable keys adapted for movement to a depressed position each having associated therewith a touch responsive sensor for producing an electrical sensor signal which varies as a function of key depression, and circuit means connected to said touch responsive sensors and to said tone generators for producing audio signals as a function of said sensor signal and said tone signal the improvement wherein said touch responsive sensor comprises first and second electrodes of electrically conductive material spaced from each other, an intermediate electrode of electrically conductive material interposed between said first and second electrodes and electrically insulated therefrom by a dielectric, means for maintaining said intermediate electrode adjacent said first electrode and means for engaging said intermediate electrode to cause reciprocal movement thereof with said key away from said first electrode and towards said second electrode and wherein said circuit means includes means connected to said electrodes for generating a first control signal in accordance with variations in capacity between said first and intermediate electrodes during the initial movement of said intermediate electrode and means for generating a second control signal in accordance with variations in capacity between said second and intermediate electrodes in the depressed position of said key.

11. In an instrument as in claim 10 wherein said first control signal generating means includes means for differentiating the electrical between said first and intermediate electrodes to produce a signal indicating key depression speed.

* * * * *